United States Patent [19]

Makowka

[11] Patent Number: 5,077,001

[45] Date of Patent: Dec. 31, 1991

[54] TAMPER-EVIDENT SEALING SYSTEM FOR ENVELOPE HAVING SPECIAL CHARACTERISTICS AND METHOD OF MAKING SAME

[76] Inventor: Kenneth R. Makowka, 19 Stirrup Pl., Wilton, Conn. 06897

[21] Appl. No.: 498,958

[22] Filed: Mar. 26, 1990

Related U.S. Application Data

[63] Continuation-in-part of Ser. No. 274,321, Nov. 21, 1988, abandoned.

[51] Int. Cl.[5] ..... B65D 33/34

[52] U.S. Cl. ..... 383/5; 383/61; 383/88; 383/84

[58] Field of Search ..... 383/5, 61, 78, 84, 88, 383/89, 90; 229/79, 80, 81, 83; 206/807

[56] References Cited

U.S. PATENT DOCUMENTS

| | | | |
|---|---|---|---|
| 468,079 | 2/1892 | Morgan | 229/81 |
| 712,465 | 10/1902 | Stormfels | 229/81 |
| 764,653 | 7/1904 | Witte | 229/79 |
| 795,505 | 7/1905 | Halloran | 229/79 |
| 932,742 | 8/1909 | Young | 229/80 |
| 1,013,571 | 1/1912 | Stevens . | |
| 1,177,886 | 4/1916 | Newcomb . | |
| 1,633,369 | 6/1927 | Hollar, Jr. | 229/79 |
| 1,667,258 | 4/1928 | Hollar, Jr. | 229/79 |
| 1,692,219 | 11/1928 | Medveczky | 229/81 |
| 3,368,741 | 2/1968 | Mercur | 229/70 |
| 3,537,637 | 11/1970 | Hiersteiner | 229/70 |
| 3,537,638 | 11/1970 | Hyman | 229/70 |
| 4,082,880 | 4/1978 | Zboril | 428/220 |
| 4,348,440 | 9/1982 | Kriozere | 383/78 X |
| 4,483,018 | 11/1984 | Whelan | 383/5 |
| 4,510,621 | 4/1985 | Sak | 383/89 |
| 4,648,860 | 3/1987 | Cassey | 493/195 |
| 4,709,397 | 11/1987 | Voshall et al. | 383/5 |
| 4,712,729 | 12/1987 | Craig | 229/72 |
| 4,720,040 | 1/1988 | Gurewitz | 232/1 |
| 4,733,817 | 3/1988 | Makowka | 229/69 |
| 4,785,940 | 11/1988 | Wilson | 383/84 X |
| 4,824,261 | 4/1989 | Provost | 383/81 |
| 4,834,552 | 5/1989 | Makowka | 383/5 |

FOREIGN PATENT DOCUMENTS

| | | | |
|---|---|---|---|
| 85308475 | 6/1986 | European Pat. Off. . | |
| 8702646 | 5/1987 | European Pat. Off. | 383/5 |
| 315911 | 11/1919 | Fed. Rep. of Germany | 229/80 |
| 7442697 | 12/1974 | France . | |
| 20637 | 11/1982 | Netherlands . | |
| 29481 | of 1906 | United Kingdom . | |
| 1380727 | 1/1975 | United Kingdom . | |
| 1470786 | 4/1977 | United Kingdom | 383/84 |
| 1536784 | 12/1978 | United Kingdom | 383/78 |
| 2051003 | 1/1981 | United Kingdom | 383/5 |
| 2149381 | 6/1985 | United Kingdom | 383/5 |
| 2200337 | 8/1988 | United Kingdom | 383/78 |

OTHER PUBLICATIONS

"Scotchmark Identification Systems", 3M Corporation.
"The Keepsafe System", Mardon Wrappings.
"Safeguard Security Envelope", Trigon Packaging Systems.
Brochure of Block & Company, Inc.
"Trigon Cache-Pak II with Lock-Sure Seal", Trigon Packaging Systems.
"Pearlescent Pigments & Iridescent Colors for Industrial Applications", The Mearl Corp.
"Mearl Pearlescent Pigments for Use in Printing Inks", The Mearl Corp.
"Mearlin Luster Pigments", The Mearl Corp.
"Mearlin Satin White News Release", The Mearl Corp.

*Primary Examiner*—Stephen Marcus
*Assistant Examiner*—Jes F. Pascua

[57] ABSTRACT

A tamper-evident seal for a plastic envelope with a pocket and closing flap having first adhesive sealing means for sealing the flap to the envelope and a second, tamper-evident sealing means adhering to the end of and extending beyond the end of the flap which also adheres to the envelope after the flap is closed and sealed. The tamper-evident sealing means has a pattern of regions, some of the regions having visually distinct reflective characteristics from others of the regions. The tamper-evident means can also have a pearlaceous material therein or thereon.

42 Claims, 6 Drawing Sheets

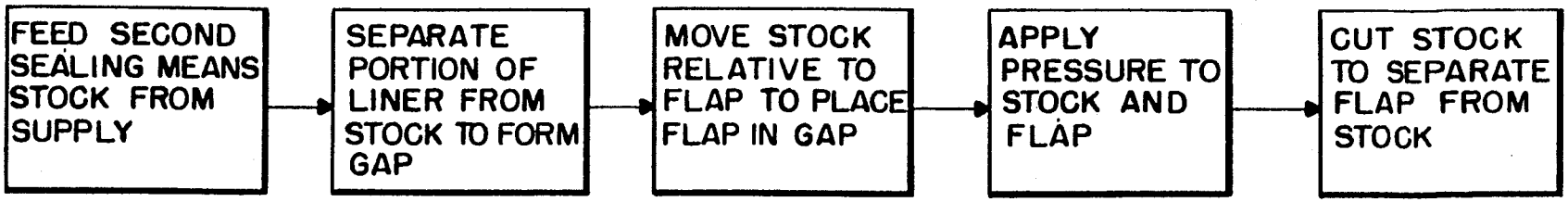
FIG. 8.
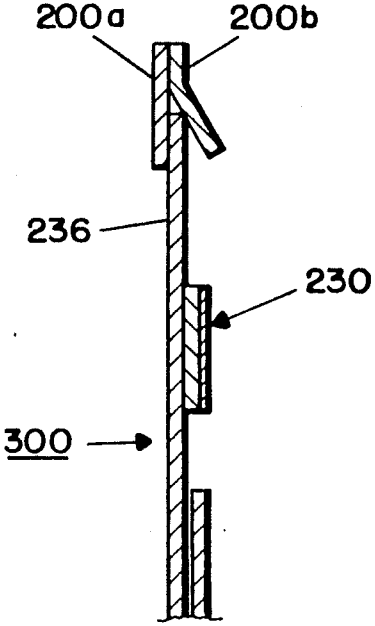
FIG. 8B.
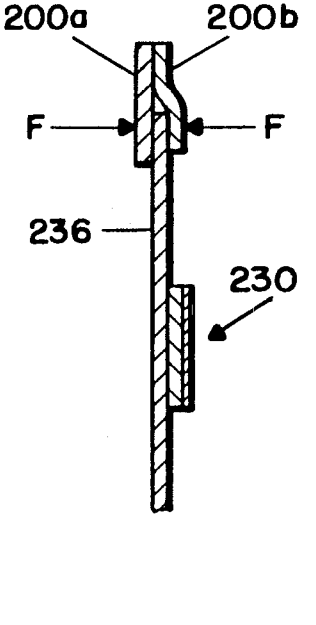
FIG. 8A.
FIG. 8C.
FIG. 8D.
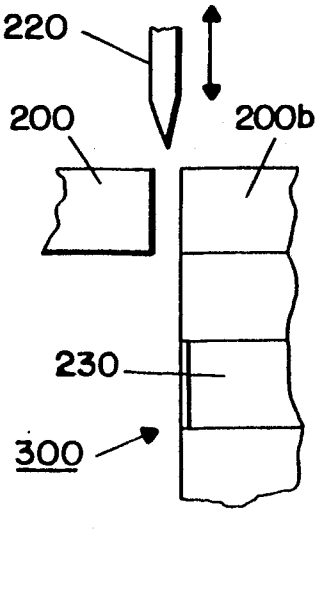
FIG. 8E.

FEED SECOND SEALING MEANS STOCK FROM SUPPLY
SEPARATION OF SECONDARY FACESTOCK FROM LINER
APPLY SECONDARY FACESTOCK TO EDGE OF ENVELOPE, PRIMARY ADHESIVE TO OTHER SIDE OF ENVELOPE, & LINER OVER PRIMARY ADHESIVE + SECONDARY FACESTOCK EXTENDING BEYOND FLAP EDGE
TRIM SECONDARY FACESTOCK, & OPTIONALLY ENVELOPE EDGE 201
200

200
200a
200b
202

200a
200b
230a
300

220
200
200b
300

TAMPER-EVIDENT SEALING SYSTEM FOR ENVELOPE HAVING SPECIAL CHARACTERISTICS AND METHOD OF MAKING SAME

This is a continuation-in-part application of my previously-filed application Ser. No. 07/274,321 filed on Nov. 21, 1988, now abandoned.

BACKGROUND OF THE INVENTION

Reference is hereby made to my related patent, U.S. Pat. No. 4,733,817, issued on Mar. 29, 1988, and my related co-pending application Ser. No. 07/172,210, filed on Mar. 3, 1988, both of which are incorporated by reference herein.

This invention relates to an envelope and method of making an envelope and, more particularly, to envelopes having a tamper-evident feature to indicate when tampering has occurred after the envelope has been closed and sealed.

There is a continuous need for containers for the shipment and handling of items, especially valuable items. In addition to the use of such containers for money, such as the deposit of daily money receipts in a bank's night depository by retail establishments, other items of value must be transferred between parties. These include checks, bonds, stocks, food stamps, coupons, medical reports and samples, jewelry, confidential documents, etc. Because of the underlying value of such items, the containers used for such transport and storage should be of high integrity. The container, in addition to being capable of being handled during transfer without breaking or or opening unintentionally to provide access to the contents, must be capable of indicating when its integrity has been compromised.

Containers of this type are known in the prior art. For instance, U. S. Pat. No. 4,483,018 discloses a container alleged to be disposable, of high integrity and tamper resistant. The container is formed of thermoplastic with an opening to insert contents. A flap with adhesive is closed over the opening and bonded to the container material. The flap has a detachable end, and both the flap and the detachable end have identical identification indicia thereon. The container also has tamper attempt indicating perforations running through the adhesive and indicia parallel to the envelope copending.

Another such security container is disclosed in European patent application 85308475.4, published June 4, 1986. Here a single container used as a security bag has a flap and lip which unite through activation of the adhesive. By the use of this structure, the bag cannot be opened without severing the material of the bag, thus making the bag tamper-evident. Once an attempt to open the bag is made, it is difficult to realign the row of slits and pilferage becomes apparent. The bond between the flap and the lip is preferably greater than between the lip and the outer surface of the rear panel. If the flap is lifted from the surface of the rear panel, the lifting action still would not result in peeling the flap from the lip and opening the bag. When the bag is used the authorized person signs his or her signature on the stripe 26 so that the signature extends across the rows of slits. The stripe 26 is called an added security feature.

A problem has recently been uncovered regarding the use of adhesive-type materials to seal plastic envelopes. It has been found that once the seal has been activated to secure the contents in the envelope, the seal can be reopened, some or all the contents removed and the flap resealed, all without any indication that tampering with the envelope flap has occurred. This can be carried out by the application of low temperatures to the adhesive region. For instance, a spray aimed from a can of freon-like material or the application of dry ice directly to the adhesive region will cause the adhesive to separate from the plastic envelope so that the flap can be lifted off the envelope and access gained to the contents. After the removal of the low temperature for a short time (approx. 1–5 minutes), the adhesive will readily reseal the flap to the plastic envelope without any evidence of tampering.

The present invention is a new and improved approach to providing a tamper-evident seal for an envelope and method of making such an envelope.

SUMMARY OF THE INVENTION

The present invention relates to a tamper-evident sealing system such as those used with security envelopes or containers, and method of making the same.

The envelope, in one embodiment, has two sealing means for joining the flap of the envelope to the envelope body when the envelope is to be closed and sealed. A first or primary adhesive sealing means preferably provides a sufficiently strong bond between the flap and the envelope so as to act as the main seal between these elements. A second tamper-evident sealing means located over the flap and adjacent panel of the envelope, when the envelope is sealed, provides an additional, tamper-evident sealing means which must be visibly violated should the first adhesive sealing means be violated and the flap opened. The second sealing means is located so that when the flap is closed and sealed, any attempt to reopen the flap, such as by applying hot or cold temperatures to the first adhesive sealing means, to thereby at least temporarily release its adhesion, will visibly show, even if the first or primary adhesive sealing means appears to have remained intact when reopened and then again closed and sealed.

In another embodiment, the second sealing means above can also carry out the function of the primary sealing means so that a single sealing means, namely the tamper-evident sealing means, provides the primary sealing function as well as the tamper-evident sealing function. This approach is particularly useful in smaller envelopes and/or envelopes made of thinner plastics. The single sealing means here can be any suitable material such as a paper stock with an adhesive.

In an embodiment of the sealing system, the second sealing means is located at, and extends beyond, the end of the flap. The portion of the second adhesive means extending beyond the end of the flap may have one or more removable protective liners over it so that the adhesive will not prematurely stick to adjacent objects. When the envelope is to be closed and sealed, the protective liners are peeled from the first and/or second sealing means, the flap folded down over the envelope opening and pressure applied to the first and second adhesive sealing means to seal the envelope. The second adhesive sealing means adheres to the envelope and the flap in the region of the end of the flap thereby providing a tamper-evident seal if any attempt is made to lift the flap.

In another embodiment of the invention the tamper-evident sealing means, having a first side facing the closing means or envelope upon which it is located and a second side facing away from the closing means or envelope upon which it is located, is provided with a pattern of regions thereon or therein. One or more of the regions may have printing thereon. Some of the regions have visibly distinct reflective characteristics from others of the regions when viewed from the second side of the tamper-evident sealing means.

In another embodiment of the invention the tamper-evident sealing means, having a first side facing the closing means or envelope upon which it is located and a second side facing away from the closing means or envelope upon which it is located, is provided with a pearlaceous material therein or thereon which is visible on the tamper-evident means when viewed from the second side. The pearlaceous material can also be iridescent. The pearlaceous material may be in or on the entire tamper-evident layer or only cover a portion or multiple portions of the tamper-evident sealing means such as in a stripe or other pattern. It may also have a coating over it.

The invention also includes the manner and method by which the second sealing means is attached onto the flap. Tamper evidency, in a preferred embodiment, can be enhanced by coloring the second sealing means a different or contrasting color compared to the envelope material.

The invention further includes a method of making a tamper-evident sealing system when provided with a pattern of visibly distinct reflective characteristics or a pearlaceous material. The pattern or pearlaceous material may be placed on the tamper-evident sealing means before or after the tamper-evident sealing means is applied to the envelope system.

BRIEF DESCRIPTION OF THE DRAWINGS

FIG. 8*e* is a schematic illustration of cutting the stock from its supply to separate the flap from the stock supply.

FIG. 8' and 8*a'*–8*d'* are schematic illustrations of an alternative method by which the first and second sealing means can be applied to the envelope.

DETAILED DESCRIPTION OF THE PREFERRED EMBODIMENTS

Although the invention is described herein in a particular environment, that of the shipment of items, particularly valuable items in a secure manner, such as in a security envelope, it is to be understood that the invention is not so limited. It can be used to contain, ship, bundle, store, etc. any type of item wherein a tamper-evident means is desirable.

The figures herein are not shown to scale. The thicknesses of the envelope material and the sealing means components are exaggerated to improve clarity of disclosure. Also the proportions of the various components are not necessarily shown to actual dimensions, the proportions used showing the important features of the invention more clearly.

As shown in the Figures, the container, here an envelope having a single pocket, is a relatively flat container which can be constructed of any suitable material. The envelope material in this embodiment is in sheet form and folded upon itself to form a pocket with a base 12 and two side seams 14, 16. The side seams may be formed in any suitable manner such as by heat welds formed by impulse welding heat sealing as commonly used in the industry or by the application of glue such as a thermoplastic glue. The seams should be of adequate strength to prevent them from being compromised or easily opened. If desirable, double or multiple panels of such material can be used to make the envelope.

Figure 1:
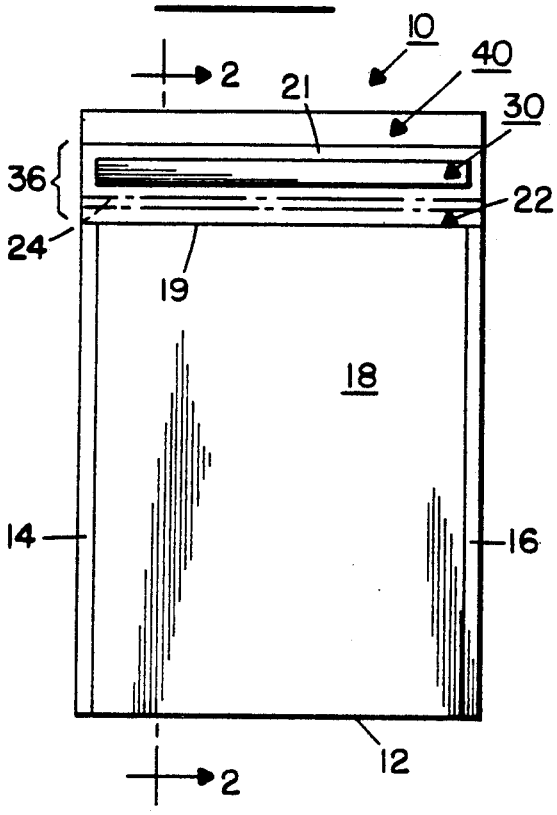
FIG. 1 is a schematic illustration of the back side of an envelope incorporating the first and second sealing means before the closing means is closed over the access opening and secured to the pocket material.
Figure 2:
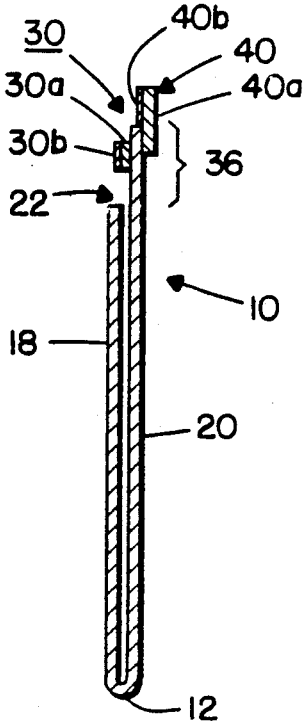
FIG. 2 is a schematic illustration of the same envelope as shown in FIG. 1 along cross-section 2—2.
Figure 2A:
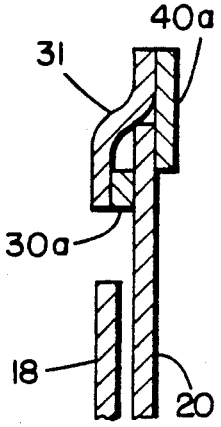
FIG. 2*a* is the same envelope as shown in FIG. 2 but with an alternative single liner which covers both the first and second adhesive means.

Envelope 10 has a front panel 20 and a back panel 18 with access opening 22 at the edge 19 of the back panel. The front panel has edge 21 which, in this embodiment, is substantially above edge 19 to form a closing means or flap 36. The access opening 22 provides an opening to the interior of the envelope pocket for the placement of items into the pocket. The front panel has a securing means or, in this embodiment, first adhesive sealing means or assembly 30 while the back panel has a second, tamper-evident sealing means or assembly 40. Assembly 30 includes first adhesive tape 30*a* adhered to flap 36 and a peelable protective covering or liner 30*b* thereon. Adhesive tape 30*a* has adhesive material on both sides of the tape. Assembly 40 includes a second adhesive tape 40*a* partially adhered to the other side of flap 36 and a peelable protective covering or liner 40*b* over the adhesive portion extending beyond transverse edge 21 of the flap. In the alternative, a single peelable protective covering or liner 31, as shown in FIG. 2*a*, can be used over adhesive means 30*a* and adhesive means 40*a*. Adhesive tape 40*a* has adhesive material on the side of the tape adjacent the flap while the other side of tape 40*a* is preferably without any adhesive material.

By removing liners 30*b* and 40*b*, or alternative liner 31, and then folding flap 36 over opening 22 and sealing adhesive tape 30*a* and sealing tape 40*a* onto the back panel, a completely sealed envelope is provided which will be tamper-evident if access to the envelope is attempted by peeling back the flap and opening the first adhesive sealing means. The adhesive is preferably of the pressure-activated type. For instance, the first adhesive sealing means can be of the type disclosed in U.S. Pat. No. 4,483,018, this patent being incorporated by reference herein.

A tamper-evident envelope system can be made having multiple pockets and the pockets can be optionally detachable, such as by perforations, or non-detachable from one another, as described in my U.S. Pat. No. 4,733,817. The pockets can be any suitable size and shape for holding the items to be contained therein. The pockets may be of varying sizes, such as a relatively small pocket and a relatively large pocket, or, in the alternative, the pockets may be the same size. The envelope system may be made of a single panel of material or of multiple panels whether there is a single pocket or multiple pockets.

Envelope system 10 is shown as being made of a single panel or sheet. The panel is folded at base 12 to form the front panel 20 and back panel 18 of the envelope system. In this embodiment fold 12 forms the bottom portion of the pocket and the side portions are formed by bonding the front and back portions together in regions 14 and 16. Bonding can be accomplished by any suitable process such as the application of pressure and heat to the envelope material where bonding is intended as is well known in the art.

The envelope may be made of any suitable material. If used for security shipments, the panel should be made of a high integrity, strong, flexible material which is resistant to tearing and puncturing and which can take high impact stresses and twisting and otherwise relatively rough handling without ill effects. Examples of suitable materials for the envelope shown in the Figures are plastic materials such as polyethylene, polypropylene, polyolefin, etc. As an example, the envelope can be made of conventional monolayer films or, alternatively, multiple layer coextruded or laminated films or construction such as polyethylene, polypropylene, polyolefin, etc. In some applications the immediately above materials may be combined with nylon, surlyn, foils, polyesters, etc. depending upon the application requirements and cost considerations.

The materials disclosed in U.S. Pat. No. 4,082,880 can also be used. The thickness of the envelope material can be any suitable dimension to provide the characteristics of the envelope as desired. For example, when using polyethylene or polypropylene, it has been found that a thickness of about 0.0002 inches (2 mils) and heavier works well for a security envelope.

The envelope material may be in the form of a single layer or multiple layer laminate or extrusion. The material may be opaque, translucent, transparent or any mixture thereof. It can be in any desired color. The envelope is desirably water-resistant and preferably watertight and airtight. However, in some applications, especially in large size envelopes, it may be desirable to place strategically small holes in the pockets to enable air trapped inside the pocket to escape after it is closed. The material may also be printed upon to affix indicia, identify the sender and/or receiver and provide intended use and instructions thereon.

As described in the aforementioned U.S. Pat. No. 4,733,817, each envelope, whether it be a single pocket envelope or a multiple pocket envelope, may have identical or somewhat similar indicia on the envelope and a detachable end portion, such as end portion on the end of the flap so that when the end portion of the flap is detached from the flap's main portion, a receipt bearing identical or similar indicia as on the pocket is provided. In using a detachable end portion extending from edge 21 of the flap, the end portion should be detached from the flap before the liner 40*b* is removed and sealed to the back panel. The indicia can be printed on the main portion of the flap or placed on some other part of the envelope such as in the center region of the envelope. The indicia can be alphanumeric or any other suitable indicia such as graphic, bar code, colors, holographic, and so forth. Alternatively, receipt numbering and a place for the sender's signature can also be placed on the liner or on a retainable portion of the liner. The liner or such portion then can be signed and used as a receipt once the liner is removed from the envelope.

Figure 3:
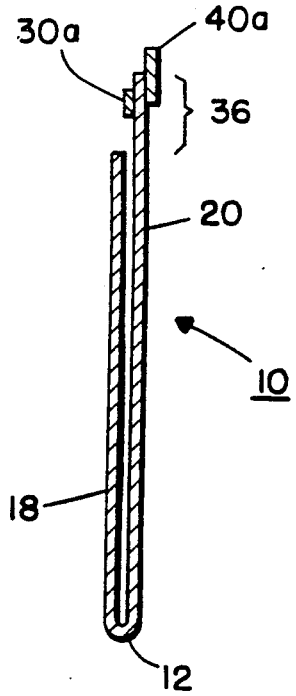
FIG. 3 is the same envelope as shown in FIG. 2 after the protective liner(s) are removed from the first and second sealing means in preparation to closing and sealing the flap over the opening.
Figure 4:
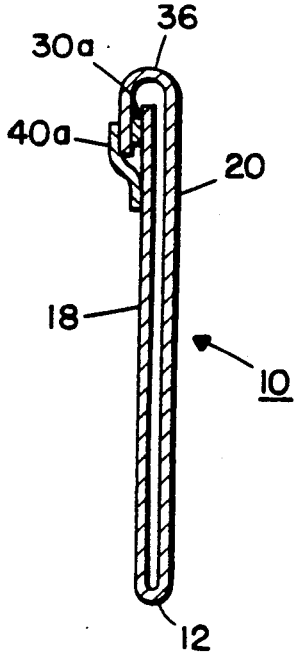
FIG. 4 is the same envelope as shown in FIG. 3 after the flap is folded over the opening and the first and second sealing means are pressed into adhering relationship with the envelope material to seal the flap thereon.

Adhesive assembly 40 may reside on the on the main potion of the flap or, alternatively, on a portion of the back panel over which the flap overlies when the flap closes on the envelope. In the envelope shown in FIGS. 3 and 4, the contents are placed in the envelope, the liner peeled from adhesive tapes 30*a* and 40*a* and discarded, or alternatively used as a receipt, and the flap folded over the opening to close the envelope. Pressure is then applied to adhesive tapes 30*a* and 40*a* to seal the flap onto the envelope.

Many alternatives and enhancements can be made to the invention as disclosed above. In multiple pocket envelope systems, the number of pockets in an envelope system can be matched to the number of item types to be handled by a system; e.g., 8, 12, 16 or more individual pockets can be made into an envelope system. The envelope material can be made in a relatively flat configuration as viewed from the side or can be made to receive thicker materials by such means as providing expandable folds in the front and back portions of the pockets. The front and/or back portions of the envelope may have address windows and areas which are particularly adapted to receive stamps and typewritten or handwritten addresses and instructions. In addition, an envelope may have an additional envelope attached to it for mailing purposes.

Figure 5:
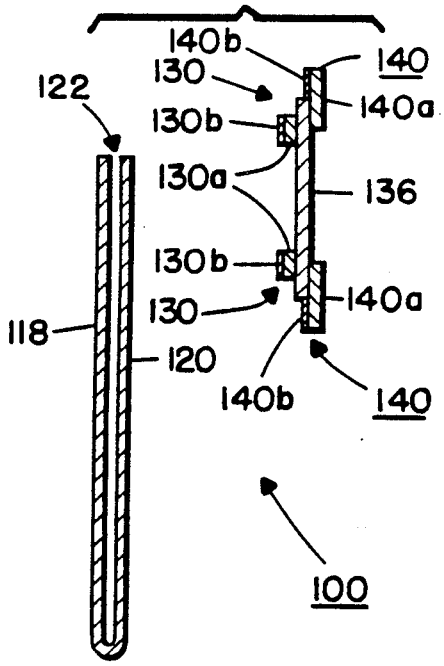
FIG. 5 is a cross-sectional view of an envelope similar to that shown in FIG. 2 except that the flap is a separate component from the envelope prior to it being sealed to the envelope.
Figure 6:
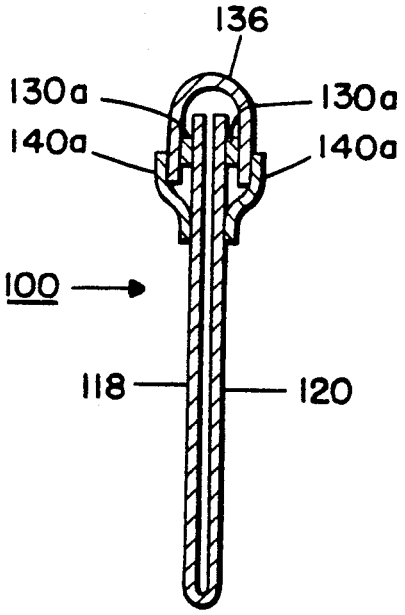
FIG. 6 is the envelope shown in FIG. 5 after the flap is sealed to the envelope over the opening.

As mentioned above, it is also possible to construct the pockets or envelopes without the flap attached as shown in FIGS. 5 and 6. In this case the flap 140 can be a separate item which would be applied over the opening 122 of the envelope 100 with means to secure the opening, such two adhesive assemblies 130 and two adhesive assemblies 140 with a fold in between so that the assemblies can be sealed to the front 120 and back 118 portions of the pocket as shown in FIG. 6 to make it completely sealed around its periphery to close the opening. In this case the flaps may be preprinted with indicia to match that of the pocket or envelope, or a particular envelope system, or may have a region thereon for the user to write in the indicia of the pocket or envelope. As shown in FIG. 2, rather than using two separate liners **130*b* and 140*b*, one single liner optionally could extend over adhesive assemblies 130*a* and 140*a***.

As described in U.S. Pat. No. 4,483,018, high integrity, tamper-evident containers or envelopes made of plastic with pressure sensitive closing means applied on opposite mateable surfaces have been disclosed in the past. In this type of envelope it has been found that the adhesive will unseal itself from the plastic with the application of low temperatures to the adhesive strip area after the envelope has been sealed. The flap can then be opened, the contents or at least some of the contents removed, and the flap resealed after the low temperature has dissipated from the adhesive region. This can be carried out in such a manner that there is no evidence, visual or otherwise, that unauthorized entry of the envelope has occurred. Furthermore, this opening procedure can be carried out quickly with the application of dry ice or the spray of "Component Cooler" catalog number 64-2321 sold by Radio Shack under the brand name "Realistic", for example. This material instantly reduces the temperature of the first adhesive sealing means to approximately −50 degrees F. Other chemicals in the chlorofluorocarbon or nitrogen families can, upon application, bring the temperatures to −200 degrees F. and lower.

As described in the aforementioned patent, perforation lines can be placed on the flap within the adhesive region and indicia disposed across the perforations. It is the intent of this system that any material distortion of the flap, such as during tampering, will disrupt the specific relationship of the indicia and visibly show the tampering attempt. This is not believed to be a reliable method of detecting tampering attempts, especially in the instance where low temperature is applied to the adhesive region, because most of the materials used in the manufacture of disposable plastic envelopes are primarily polyolefins and are non-porous. Consequently, the adhesive does not penetrate into the plastic material, due to close molecular structure, but rather only adheres to the outer surface of the plastic. Under extraordinary conditions, such as upon application of low or high temperatures, the adhesion dissipates or releases the bond as it temporarily crystalizes and the flap can be opened and then resealed as the adhesive relatively quickly regains its properties as it returns to normal temperature.

A main feature of the invention herein is the use of first adhesive sealing means, such as adhesive tape **30*a* between flap 36** and the plastic envelope panel to strongly and securely hold the flap closed under ordinary conditions together with second, tamper-evident sealing means over the flap and plastic envelope which is tamper-evident. When extreme cold is placed against the first adhesive sealing means, such as by the application of dry ice, to open the first seal, remove all or part of the contents and then reseal the first sealing means without any visible indication that the first sealing means has been opened, the second sealing means prevents the flap from being lifted without applying force to the second sealing means. When this is done and an attempt to lift the flap and/or the second sealing means is made, the second sealing means will visibly distort or break apart. This will happen even if extreme hot or cold temperatures are applied to the second sealing means because of their destructible characteristic. Thus, the second sealing means need not be necessarily as strong as the first sealing means, but only need to visibly show that tampering has occurred. This is its main function in the sealing system.

Any type of suitable destructible material can be used. Layers **30*a* and 40*a* can optionally be hot melt adhesive applied directly to the envelope or an adhesive tape, for instance. As an example, layer 40*a* can be an adhesive tape such as a product made by 3M corporation Minneapolis, Minn. which is described in their product brochure "ScotchMark Brand Identification Systems" and called "Y-812 Red Tamper Resistant Tape" and "Y-813 Transparent Tamper Resistant Tape". These are described as tapes which combine a fragile transparent acetate film with an aggressive adhesive to form a highly destructible tamper resistant tape. When the edges are serrated, tamper resistance on packages is significantly increased. Tape 40*a*** preferably is provided in a different or contrasting color compared to the envelope material or has printing such as on the adhesive side to enhance tamper-evidency. Also a colored dye such as red can be used with the adhesive to stain substrates if solvents are used to remove the tape. The product specifications are as follows:

| | PRODUCT DESCRIPTION | APPROXIMATE THICKNESS |
|---|---|---|
| Facestock | Matte Transparent Acetate Film | 0.0016 in. (0.0406 mm) |
| Adhesive | #300 "Hi-Strength" (Y-812 has red dye in adhesive) | 0.0018 in. (0.0457 mm) |
| | Total Thickness | 0.0034 in. (0.0863 mm) |

Figure 7:
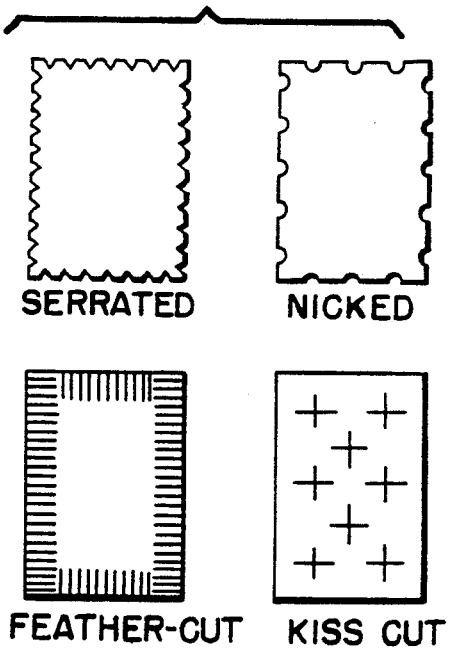
FIG. 7 depicts serrated edges, notches edges, feather-cut edges, and kiss cut (die cut) techniques, respectively, that can be used alone or in combination on the facestock to propagate tearing.

When the facestock is serrated, notched, or feathercut, as depicted in FIG. 7, the edge tear resistance is reduced sharply. All of the above mentioned types of edge treatments propagate tearing of acetate, paper, vinyl, or other facestock materials. Especially, when adhesive tapes are provided in contrasting colors to the envelope material or are printed such as in one or more colors, the facestock, as it is lifted off the envelope, will break into small pieces, distort, and or become of disrupted continuity. As such it will become impossible to reconstruct the tape to its original state and tampering will be easily recognized. Consequently, when the tape is applied as a security seal and allowed a short period of dwell (15 minutes), attempts to remove the tape in most cases will result in a tearing of the film. Attempts to separate the adhesive from a smooth or porous surface may leave a thin layer of adhesive. Solvents capable of removing the adhesive may activate the red dye in the Y-812 model and may cause it to stain a paper or film surface. The adhesive develops an excellent bond to smooth and porous papers, polyethylene, polyester and many other smooth plastic surface plastics. This product, when the edges are serrated, is suggested by the manufacturer for tamper resistance on packages in the pharmaceutical, food, cosmetic and law enforcement industries.

An alternative type of destructible tape for use as the second, tamper-evident sealing assembly 40 is one generally available in the marketplace with a backing material made of acetate, vinyl, paper, etc. with a lighter concentration of adhesive thereon. This provides an adhesive that will adhere more quickly to the envelope (and liner when used), is relatively strong in the longitudinal direction, (which is important when considering the automatic application of the tape to the envelope), and relatively weak in the transverse (width) direction for adequate destructibility. An example of this tape is catalog #S-730 or S-730B adhesive on 1.5 matte acetate, marketed by Fasson of Painesville, Ohio. This type of tape is very desirable for the second sealing means in that it generally, is sold with a liner such as paper which can be peeled back selectively to enable the tape to be applied automatically to the envelope.

Figure 7A:
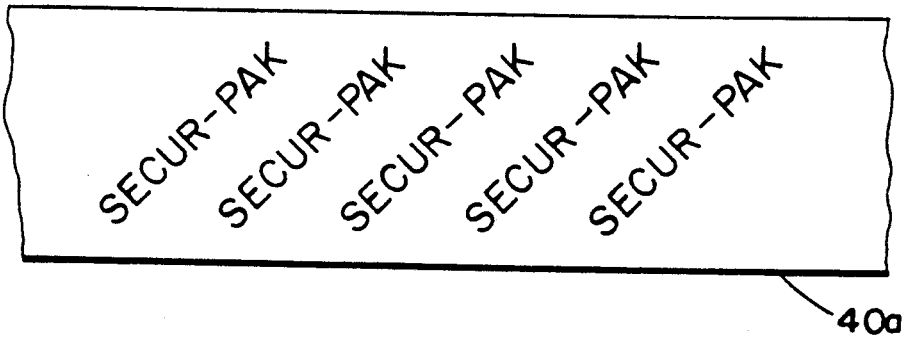
FIGS. 7*a–c* illustrate how printing can be applied to the second, tamper-evident sealing means to enhance its tamper-evidency characteristics.
Figure 7B:
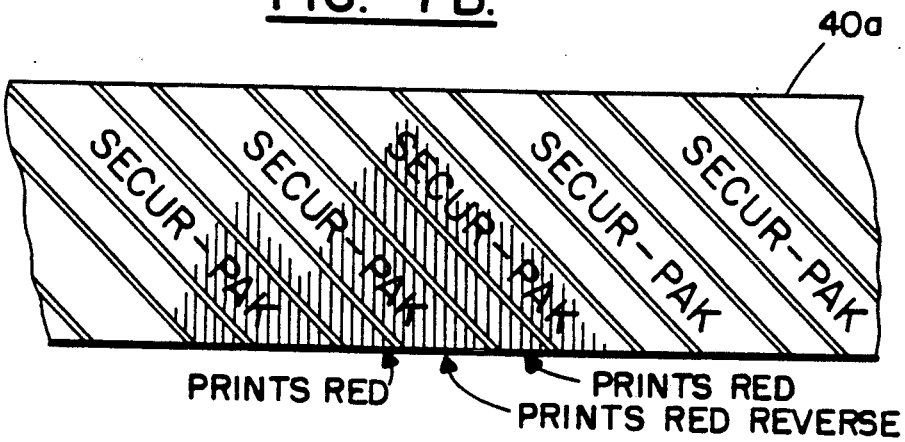
Figure 7C:
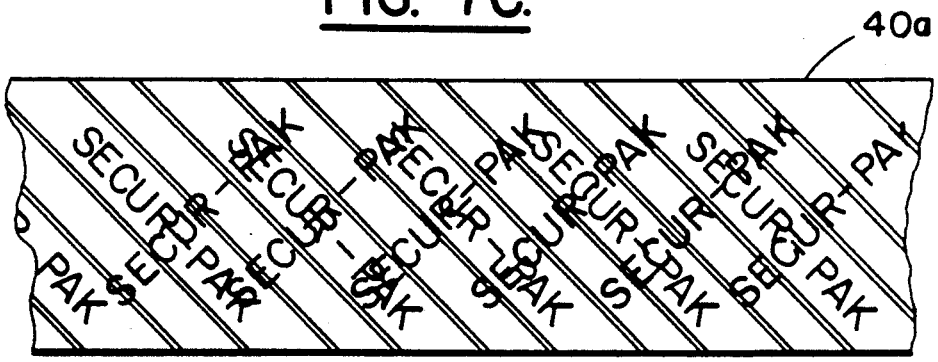

The tape may be printed either on its top or face side or on its backing and/or on the adhesive to further enhance its tamper-evidency. Various patterns of such printing and various methods of application of the printing are possible. For instance, as depicted in FIGS. 7*a–c*, a multiple printing scheme is shown. As shown in FIG. 7*a*, the word "SECUR-PAK" is printed in a first direction, such as on clear material, and in a suitable color such red. Then, as shown in FIG. 7*b*, the word is printed again, here in slightly different letter style, in a second direction with alternate stripes of a suitable color such as black in the area of the wording and between the wording. The red stripe can be printed on top of the tape between the wording and/or on the bottom of the tape in the area of the wording. FIG. 7*c* shows the final product of the above steps. The design and printing techniques along with the use of colors as described above further impedes any possibility of a faithful reconstruction of the second adhesive means once it is lifted and breaks apart.

It is preferred to place a protective covering or liner over that portion of the second, tamper-evident sealing means that extends beyond the flap. As described beforehand, one liner can be used to cover both the first and second adhesive means. This liner enables the envelope to be packed, stored, handled, etc. before closing the flap without the adhesive on tape 40*a* prematurely sticking to an adjacent object. If tape such as the 3M Y-812 or Y-813 is used, the liner will have to be applied to the portion of the tape extending beyond the transverse edge of the flap either before, during or after the tape is placed on the flap. However, if the Fasson acetate with S-730B label stock is used which already has a liner thereon, the portion of the liner to adhere to the flap will have to be separated from the tape before the tape is pressed onto the end of the flap. In any event the placement of the second, tamper-evident sealing means onto the envelope, whether it has a liner pre-attached or not, can be accomplished by an automatic process.

Figures 8, 8A, 8B, 8C, 8D:
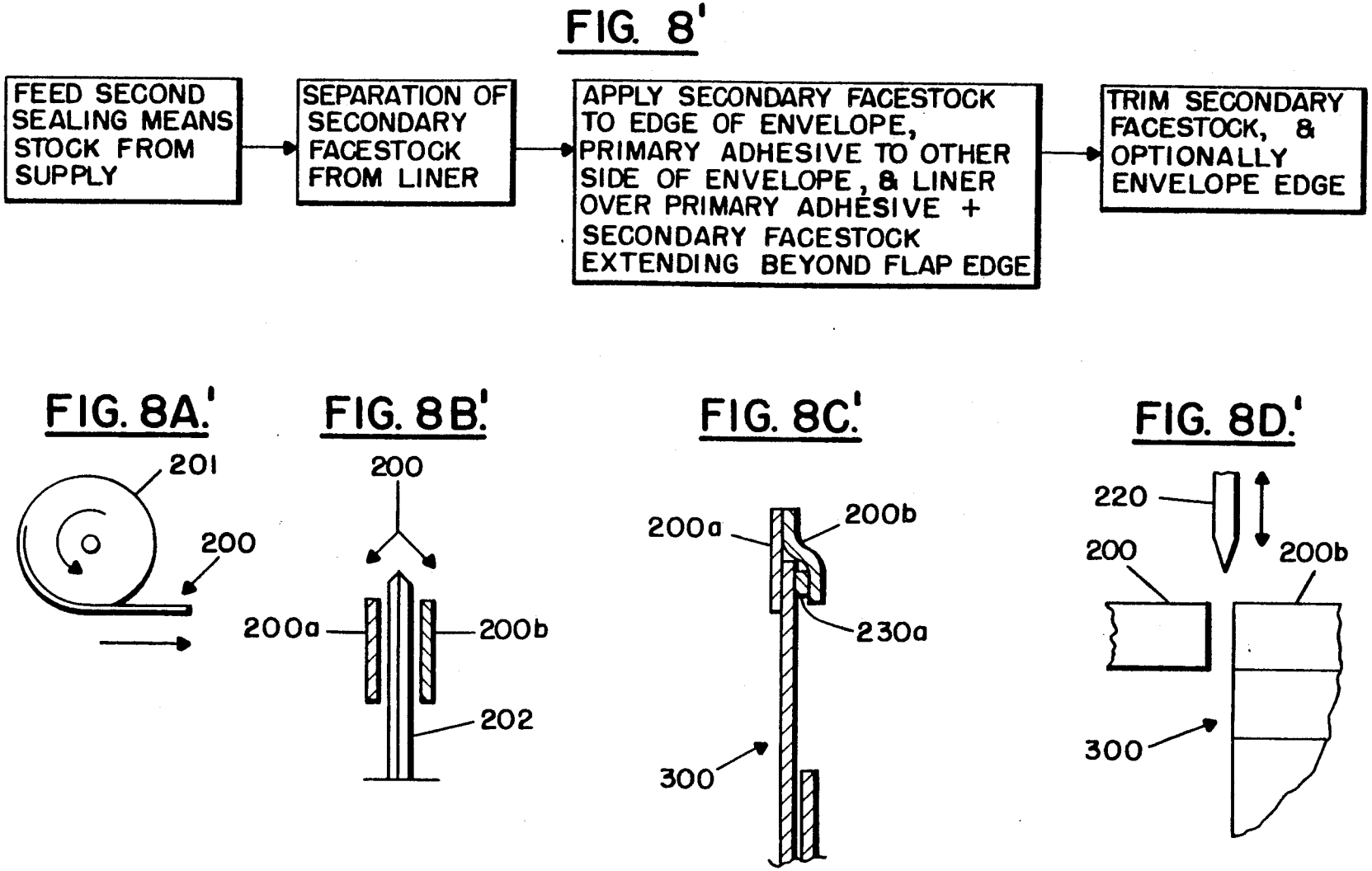
FIG. 8 is flow chart of a representative manner by which the second, tamper-evident sealing means can be automatically applied to the flap.
FIG. 8*a* is a schematic illustration of feeding second sealing means stock from a supply.
FIG. 8*b* is a schematic illustration of separating a portion (along the width of the stock) of the protective liner from the stock to form a gap, the stock and tool being shown in section.
FIG. 8*c* is a schematic illustration of moving the stock relative to the flap to place the outer transverse edge of the flap into the gap between the liner and the adhesive tape, the envelope and stock being shown in section.
FIG. 8*d* is a schematic illustration of applying pressure to the stock and flap to seal the stock to the flap, the flap and stock being shown in section.

A process for quickly assembling the second sealing means to the envelope flap is now described in conjunction with FIG. 8 and FIGS. 8*a–e*. In this case, the second sealing means assembly 200 is provided from a supply, such as a reel, roll, or spool and it is of the variety that already has the liner thereon. As shown in the chart of FIG. 8, the first step is to provide assembly stock 200 including the adhesive tape 200*a* with liner 200*b*. This can be done in any suitable manner such as by feeding the stock from reel 201 towards a liner separator tool 202.

The next step is to selectively separate the portion of the liner 200*b* from the adhesive tape that will adhere to the flap. This is shown in FIG. 8*b* wherein tool 202 and stock 200 are moved relative to one another with the tip of the tool inserted between the liner 200*b* and tape 200*a* to the extent that tape 200*b* will overlap the flap when assembled thereto. The tool creates a gap between the liner and tape into which the end of the flap will be placed. After the tool has separated the preselected portion on the liner, the tool is removed from the stock.

Next, the end of the flap 236 and gap between liner 200*b* and 200*a* are moved relative to one another so that the second sealing means 200 can be applied to the flap or bottom side of the liner. Although first adhesive sealing means 230 is shown already on the flap, it could be applied during or after the second sealing means. Then pressure is applied to the stock and flap, depicted as arrows "F" to seal the tape 200*a* onto the end of the flap as shown in FIG. 8*d*. Thereafter, as shown in FIG. 8*e*, the portion of the stock adhering to the flap is severed from the supply of stock, such as by a movable knife 220, or a hot wire, so that the envelope just having has its second, tamper-evident sealing means applied can be removed and the process repeated for the next envelope.

Figure 9:
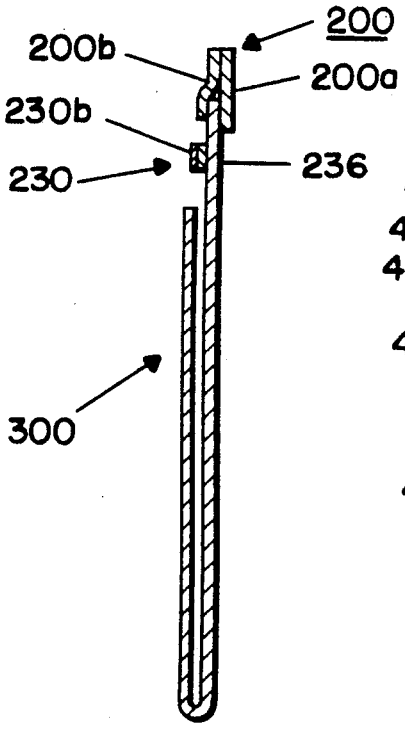
FIG. 9 is a schematic illustration of the envelope with a flap bearing the second sealing means as made according the method described in FIG. 8 and FIGS. 8*a'–e*, the envelope being shown in section.

FIG. 9 shows the completed envelope having first adhesive sealing means 230 and second tamper-evident sealing means 200. To use the envelope, contents are placed into the envelope, liners 200*b* and 230*b* are removed from the adhesive tapes, the flap folded over and pressure applied, such as manually, over adhesive tapes 200*a* and 230*a* to seal the flap.

An alternative process for assembling the seals onto the envelope is shown in FIG. 8' and FIGS. 8*a'–*8*d'*. Here the second adhesive means 200 is fed from supply roll 201 to separator 202 which completely separates the liner 200*b* from the adhesive tape 200*a*. The adhesive tape is then placed on the flap of the envelope, a hot melt adhesive 230*a* placed on the other side of the flap or on the liner for the first adhesive means, and then a single liner 200*b* placed over the first adhesive means 230*a* and second adhesive means 200*a*. The separator tool 202 is used as a guide to assure that both the liner and adhesive tape 200*a* come back together properly. The adhesive means and liner are then trimmed along the envelope edge. To seal this envelope, liner 200*b* is removed, the flap folded over, and pressure applied over adhesive means 200*a* and 230*a* to seal the flap to the envelope.

Other methods may be used to place the second sealing means onto the flap. For instance, when the 3M tape is used, which is not generally provided with a liner, the tape can be placed on the end of the flap with a portion of the adhesive side of the tape extending beyond the end of the flap to form an exposed portion of the adhesive side of the tape. Then a liner material can be fed onto the exposed adhesive to avoid having it prematurely stick to an object before intended use. In the case of applying a second sealing assembly to the flap that has a liner already attached, the portion of the liner described as separated from the tape in FIG. 8 and FIGS. 8*a–e* could be, instead, cut and totally removed from the remainder of the stock so that the remaining undisturbed liner portion would be the only place having liner material thereon.

Figure 10A:
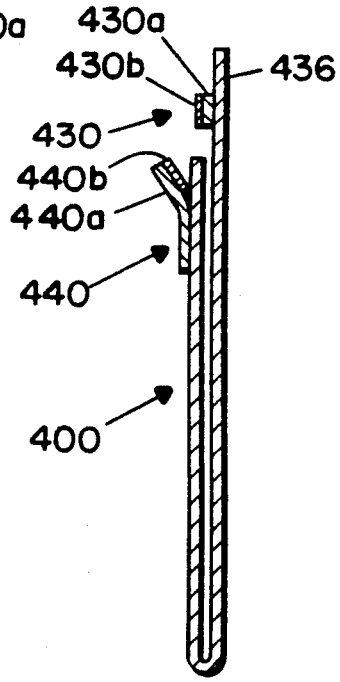
FIGS. 10*a* and 10*b* are schematic illustrations of an alternative embodiment of the sealing system wherein the second, tamper-evident sealing means is attached to the envelope body rather than the flap before the envelope is sealed, FIG. 10*a* depicting the envelope before it is sealed and FIG. 10*b* depicting the envelope after it is sealed, both views being in section.
Figure 10B:
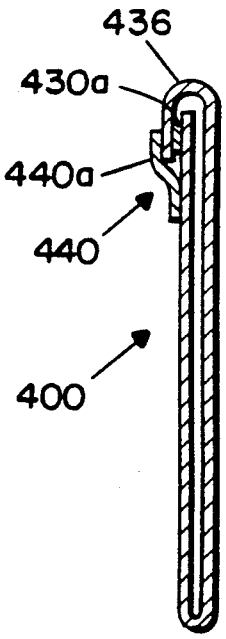

Another embodiment of the invention is shown in FIGS. 10*a* and *b*. Here, the second, tamper-evident sealing assembly 440 is applied to the back panel of the envelope before the flap is closed and sealed as opposed to being applied to the flap itself. The flap still has first sealing assembly 430 on it in this embodiment. FIG. 10*a* shows the envelope before it is sealed. Second seal assembly 440 has a liner 440*b* which extends only over a portion of the adhesive tape 440*a* and is located between the envelope material and adhesive tape. When using this envelope, the liners 430*b* and 440*b* are peeled from the assemblies 430 and 440, respectively, the flap folded over and the end of it placed between the envelope and adhesive tape 440*a*, and pressure applied to adhesive tapes 430*a* and 440*a* to seal the envelope.

The second, tamper-evident sealing means provides evidence of tampering with the sealed flap when such occurs even by the application of low temperatures to the seal, because the forces used to try to lift the flap to give access to the contents of the envelope always breaks apart, distorts, and disrupts the continuity of the tamper-evident means. Such distortion and breakage cannot be put back together if an attempt is made to reseal the flap. The forces act in this fashion on the tamper-evident means regardless of how the flap is actually separated after the application of low temperature to the seal system. It is believed that such breaking apart and distortion always occurs in the tamper-evident means upon an attempt to lift the flap because the fragile nature of the second sealing means.

The tamper-evident layer provides tamper evidence even when low temperatures are placed in the regions of the first sealing means in stark contrast to the prior art systems. When low temperatures are applied to envelopes having only the type of sealing systems described herein as the first sealing means, the adhesive strip can be readily pulled off and resealed without any visible evidence of tampering occurring on the plastic envelope or flap or adhesive strip.

One problem that has recently surfaced in the use the tamper-evident sealing means described above is that the tamper-evident sealing means, such as 40*a*, once it has been sealed onto the closing means and envelope, can be very carefully cut with a razor blade such as horizontally or parallel across the closure. It is then possible to remove some or all of the contents of the envelope, such as with the aid of tweezers or other implement without visibly disturbing the tamper-evident nature of the sealing means. The cut then can be concealed from easy visual detection by placing readily available mending tape over the cut such as ordinary "Scotch" brand tape.

This is generally done by very carefully cutting directly through the tamper-evident sealing means, closing means and envelope to make a very narrow, slit-type breech in the system without disturbing, distorting, breaking apart, or disrupting the continuity of the tamper-evident sealing means in a sufficient manner to make such a violation readily apparent or readily detectable by ordinary visual inspection. Commonly available tapes such as "Scotch Magic Tape", catalog No. 810,"Scotch Removable Magic Tape", Catalog No. 811,"Scotch Transparent Tape" catalog No. 600, and "Highland Permanent Mending Tape", catalog No. 6200, are all examples of tapes that can be applied over the slit to conceal it. "Scotch", "Magic" and "Highland" are trademarks of 3M Corporation of Minneapolis, Minn. If the slit is made carefully enough and the tape, or any other material with adhesive that would match the surface of the secondary sealing means, is placed over the slit and smoothed on adequately, it may be very difficult to determine that the tape and slit exist in the tamper-evident sealing material.

Figure 11:
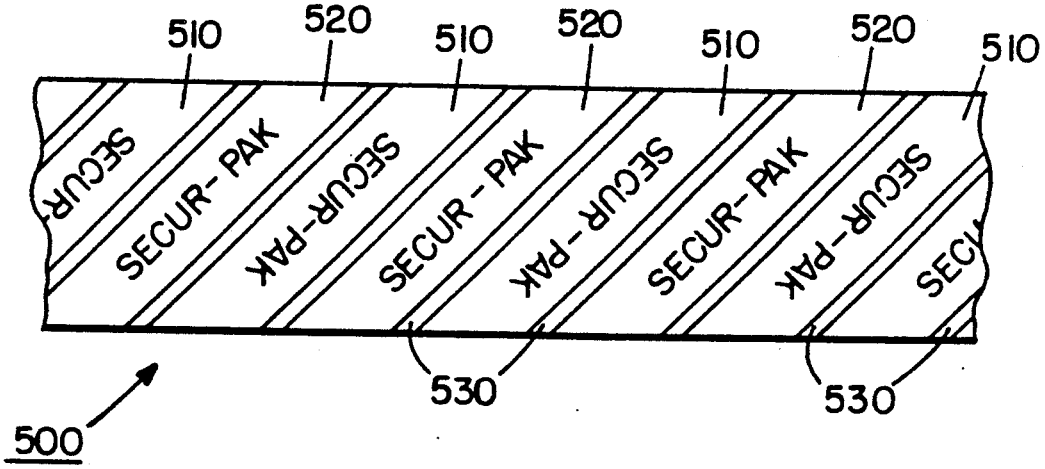
FIG. 11 is a schematic illustration of the tamper-evident sealing means having a pattern of regions, some of the regions having visually distinct reflective characteristics from others of the regions, including pearlaceous material.

It has been discovered that the existence of the tape and slit are much more visually detectable if there is a pattern of regions having visually distinct characteristics placed on or in the tamper-evident sealing tape which will highlight the existence of the tape once it is placed on the sealing means. To overcome this potential problem, the tamper-evident sealing means, having a first side facing the closing means or envelope upon which it is located and a second side facing away from the closing means or envelope upon which it is located, is provided with a pattern of regions thereon or therein, some of the regions having visibly distinct reflective characteristics from others of the regions when viewed from the second side of the tamper-evident sealing means. A representative embodiment of this tamper-evident sealing system is shown in FIG. 11 The tamper-evident sealing means 500 may be used in lieu of adhesive tape 40*a* on envelope 10 in FIGS. 1–4 herein.

Tamper-evident sealing means 500 has a pattern of regions thereon, some of the regions having visibly distinct reflective characteristics from others of the regions when viewed from the second side of the tamper-evident sealing means, e.g., the side facing away from the closing means or envelope. For example, in FIG. 11, regions 510 may have a matte-type finish while regions 520 may have a gloss or semi-gloss type finish. In the particular example shown in FIG. 11, a further variation is used. There is an optional third region, 530, which can be a transparent or semi-transparent region, in this case acting as stripes between each of the other regions 510 and 520. To further enhance the tamper-evidency of the embodiment shown in FIG. 11, especially when tapes are used to cover up tampering with the envelope, regions 510 may optionally have a particular color such as black along with the matte-type finish while regions 520 may optionally have a different color such as red along with the gloss or semi-gloss type finish. Many variations are possible such as printing indicia on the tape, such as the trademark "SECUR-PAK", in a third color, for example, white, and also printing the stripe region 530 in white or even a fourth color. It should be understood that the particular characteristics of the regions on or in the sealing means 500 may be any visually distinct one from region to region as long as the effect is to more readily detect when a tampering of the sealing means is being covered up by the use of tape or other similar means over the point of entry. Similarly, various indicia and colors as well as transparent regions, opaque regions, and other characteristics can be used to advantage for the intended purpose.

In another embodiment of the invention the tamper-evident sealing means is provided with a pearlaceous material therein or thereon which is visible on the tamper-evident means when viewed from the second side. The pearlaceous material can also be iridescent. The pearlaceous material may cover the entire tamper-evident sealing means or only cover a portion or multiple portions of the tamper-evident sealing means such as in a stripe, or other pattern, as shown in FIG. 11 as stripe 510. The use of the pearlaceous material on the tamper-evident sealing means enables the presence of tape over an illicit slit to be clearly seen. The pearlaceous material may also have a coating over it as long as the material is visible from the second side of the tamper-evident sealing means. In addition, nacreous or iridescent materials may be used for this purpose.

Pearlaceous material is one that resembles mother of pearl or has a pearl-like appearance or quality. Iridescent material is one that has or shows an interplay of colors like the rainbow and has a prismatic quality. Any suitable material that exhibits these characteristics can be used. Examples of such materials are commercially available from The Mearl Corporation, 41 East 42nd Street, New York, N.Y. 10017 and are sold under the names of "Mearlin and Mearlite Pearlescent Pigments and Iridescent Colors" and "Mearlin Luster Pigments". "Mearlin" and "Mearlite" are registered trademarks of The Mearl Corporation.

For instance, in catalog number PCL-303 RR-11/89 entitled "Mearlin Luster Pigments", all of the product numbers mentioned would be suitable. Other catalogs of The Mearlin Corporation disclosing suitable pearlaceous and iridescent materials include catalog number RL888 entitled "Mearl Pearlescent Pigments for Use in Printing Inks" and catalog number 89988-94/RL3099 entitled "Pearlescent Pigments & Iridescent Colors for Industrial Applications". All of the above-mentioned catalogs are incorporated by reference in this application.

The nature of pearlaceous materials is that the individual particles are generally a very thin crystalline platelet. The crystals are readily oriented into parallel layers because of their shape. Being transparent each crystal reflects only part of the incident light reaching it and transmits the remainder to the crystals below. It is the simultaneous reflection of light from these many microscopic layers that produces the particular kind of shimmery luster which is called pearlaceous or "pearlescence" by The Mearl Corporation in their catalogs. The platelets are most effective when they are individually dispersed thereby presenting the maximum number of reflecting surfaces, and also when they are well oriented thus achieving reflectivity in a uniform direction. These materials are capable of providing a variety of optical appearances from brilliant luster to soft velvety sheen and come in a wide variety of colors. These effects are well suited to the present application.

These materials are typically made of mica platelets coated with titanium dioxide and/or iron oxide or platelike crystals of bismuth oxychloride. The Mearl Corporation products "Mearlin Satin White", a titanium dioxide-coated mica pigment characterized by its very fine particle size and high reflectivity and "Iridescent Glitter", catalog number PGL-422-015, are suitable products for this application.

In the embodiment wherein the closing means is separate from the envelope, two first adhesive sealing means, one on each side of the envelope opening, may be used to seal the closing means to the envelope. Similarly, two second, tamper-evident, sealing means, in operative relationship with each transverse edge of the closing means may be used to close the separate closing means. In the embodiment wherein the second, tamper-evident, sealing means is solely used on the closing means to seal it to the envelope and the closing means is separate from the envelope, two tamper-evident sealing means may be used to seal the closing means to the envelope, one on either side of the envelope opening.

A suitable second, tamper-evident, sealing means, whether used in conjunction with the first, adhesive, sealing means or alone, to seal the envelope is paperstock with an adhesive thereon. For instance, a 32 lb. computer printable light weight paper such as Technicote Product Number 1663 Lithopaper with a 50 lb. liner and a TS 523 Perm. Adhesive (substantially the same as that disclosed above in relation to the 3M adhesive tape) may be used. If printing is to be placed on or in such a paperstock sealing means, Flair 100 (base-clear) or Flair 210 (interference violet) marketed by EM Industries, Hawthorne, N.Y. is a suitable choice. Ordinary copier address labels such as those that are relatively thin and /or are relatively light weight can be used with success for the tamper-evident sealing means, especially for small, light guage, e.g., 1.5–2 mils, clear plastic bags. Commonly available labels of this type include "PRES-a-ply/ Self-Sticking Copier Labels for plain bond copiers", catalog number 37–121, marketed by Dennison Manufacturing Company, Framingham, Mass., and "AVERY Self-Adhesive Address Labels for Plain Paper Copiers", catalog number 5360, marketed by Avery Label, Azusa, Cal. The Cheshire Company of Mundelein, Ill. also produces labels of this type of relatively light weight with serrated edges that have been found to be suitable for this purpose. Such label stock has the added advantage of allowing the user to stamp or write identification indicia, dates, etc. thereon.

The invention further includes a method of making a tamper-evident sealing system with the pattern of regions. The pattern of regions may placed on the tamper-evident sealing means before or after the tamper-evident sealing means is placed on the closing means or envelope.

The additional step of placing another adhesive sealing means on the closing means or on the envelope where the closing means overlies the envelope when forming a closed pocket, for sealing the closing means to the plastic, may also be added to the method.

The application of the pattern of regions can be accomplished in a variety of different known techniques in the security envelope art. For instance, the tamper-evident sealing means may be processed through two coating steps in succession, the first applying a matte-type coating only in regions 510 and the second applying a gloss or semi-gloss type coating only in regions 520. The same technique may be used to apply the printed indicia and regions 530. Another approach may be to chemically or electrically treat the regions 510 and 520 within the tape itself to create the different regions of the pattern. Printing could also be applied to the surface(s) of the tape or placed within layers of the tape to produce the same effect. Although the pattern shown in the embodiment of FIG. 11 is that of repeating stripes, any suitable pattern may be used. For instance, the pattern optionally may be checkerboard, symbols of one visual characteristic placed over a continuous undercoating of another distinct visual characteristic, etc.

The same methods can be used when using pearlaceous and iridescent materials. When such materials are applied across the entire tamper-evident sealing means a roller or flood coat coating process can be used. Furthermore, the tamper-evident sealing means, or for that matter the entire security envelope, either separately or together, can be coated with these materials for maximum tamper-evidency.

The combination of pearlaceous materials along with the pattern of regions having visibly distinct reflective characteristics from others can be used. For instance, the tamper-evident sealing means could be flood coated with the pearlaceous material and then the combination of matte and gloss stripes laid thereover with the regions between the stripes being the pearlaceous material. The reverse of this process could be carried out wherein the pearlaceous material is applied in only some regions of the tamper-evident sealing means after the matte/gloss or semi-gloss pattern is applied. Many other variations of the process of applying these materials for the intended effect are also possible.

It should be understood that the foregoing description is only illustrative of the invention. Various alternatives and modifications can be devised by those skilled in the art without departing from the invention. Accordingly, the present invention is intended to embrace all such alternatives and variances which fall within the scope of the appended claims.

I claim:

1. A tamper-evident sealing system for use with an envelope made at least partially of plastic material comprising:

envelope pocket having an opening therein through which contents can be placed into the pocket; plastic closing means which when placed over and secured to the plastic envelope material forms a closed pocket, the closing means having at least one transverse edge;

tamper-evident sealing means located on the closing means and extending beyond the transverse edge of the closing means, or, alternatively, on the envelope adjacent to where the transverse edge of the closing means overlies the envelope when forming a closed pocket in which case a portion of the tamper-evident sealing means does not adhere to the envelope, which enables the closing means and envelope to be sealed to one another, the tamper-evident sealing means upon sealing the envelope and closing means together, becoming visibly distorted, broken apart, or of disrupted continuity if attempts are made to reopen the tamper-evident sealing means whereby tamper-evidency is provided to the envelope system; and the tamper-evident sealing means having a first side facing the closing means or envelope upon which it is located and a second side facing away from the closing means or envelope upon which it is located, and a pattern of regions, some of the regions having visibly distinct reflective characteristics from others of the regions when viewed from said second side of the tamper-evident sealing means.

2. The sealing system as in claim 1 wherein adjacent regions in the pattern of regions have visibly distinct reflective characteristics.

3. The sealing system as in claim 1 wherein some of the regions have a relatively transparent characteristic while the others have a relatively non-transparent characteristic.

4. The sealing system as in claim 1 wherein the some regions are of a given color while the other regions have a different color.

5. The sealing system as in claim 1 wherein the tamper-evident sealing means contains indicia.

6. The sealing system as in claim 1 wherein the closing means is a flap means integral with the pocket.

7. The sealing system as in claim 1 wherein the closing means is a separate member from the pocket.

8. The sealing system as in claim 1 wherein the tamper-evident sealing means material is one which is activated by placing the closing means onto the envelope over the opening and applying pressure to the sealing means.

9. The sealing system as in claim 1 wherein the portion of the tamper-evident sealing means which does not adhere to the closing means or the envelope has a removable liner thereon to prevent the tamper-evident sealing means from prematurely sticking to an adjacent object.

10. The sealing system as in claim 1 wherein one or more of the edges of the tamper-evident sealing means is serrated, notched or scored.

11. The sealing system as in claim 1 wherein the tamper-evident sealing means contains different or contrasting color from the envelope material or closing means.

12. The sealing system as in claim 1 wherein the tamper-evident sealing means has printing thereon to enhance its tamper-evidency.

13. A tamper-evident sealing system for use with an envelope made at least partially of plastic material comprising:

envelope pocket having an opening therein through which contents can be placed into the pocket;

plastic closing means which when placed over an secured to the plastic envelope material forms a closed pocket, the closing means having at least one transverse edge;

first adhesive sealing means, located on the closing means or, alternatively, on the envelope where the closing means overlies the envelope when forming a closed pocket, for sealing the closing means to the plastic envelope material;

second, tamper-evident sealing means located on the closing means and extending beyond the transverse edge of the closing means, or on the envelope adjacent to where the transverse edge of the closing means overlies the envelope when forming a closed pocket in which case a portion of the second, tamper-evident sealing means does not adhere to the envelope, which enables the closing means and envelope to be sealed to one another, the second, tamper-evident sealing means, upon sealing the envelope and closing means together, becoming visibly distorted, broken apart, or of disrupted continuity if attempts are made to reopen the second, tamper-evident sealing means whereby tamper-evidency is provided to the envelope system even if the first sealing means can be reopened and reclosed without visual detection thereof; and the second, tamper-evident sealing means having a first side facing the closing means or envelope upon which it is located and a second side facing away from the closing means or envelope upon which it is located, and a pattern of regions, some of said regions having visibly distinct reflective characteristics from others when viewed from said second side of said second tamper-evident sealing means.

14. The sealing system as in claim 13 wherein adjacent regions in the pattern of regions have visibly distinct reflective characteristics.

15. The sealing system as in claim 13 wherein the some regions are of a given color while the other regions have a different color.

16. The sealing system as in claim 13 wherein the second, tamper-evident sealing means comprises a fragile material with an adhesive that forms a highly destructible sealing means.

17. A tamper-evident sealing system for use with an envelope made at least partially of plastic material comprising:

plastic closing means which when placed over and secured to the plastic envelope material forms a closed pocket, the closing means having at least one transverse edge;

first, adhesive sealing means, located on the closing means or, alternatively, on the envelope where the closing means overlies the envelope when forming a closed pocket, for sealing the closing means to the plastic envelope material; and second, tamper-evident sealing means located on the closing means and extending beyond the transverse edge of the closing means which enables the closing means to be sealed to the envelope when the closing means is secured to the envelope to form a closed pocket, the second sealing means, once being sealed to the envelope, becoming visibly distorted, broken apart, or of disrupted continuity if attempts are made o reopen the second sealing means whereby tamper-evidency is provided even if the first sealing means can be reopened and reclosed without visual detection thereof; and the second, tamper-evident sealing means having a first side facing the closing means and a second side facing away from the closing means, and a pattern of regions, some of said regions having visibly distinct reflective characteristics from others when viewed from said second side of the second tamper-evident sealing means.

18. The sealing system as in claim 17 wherein adjacent regions in the pattern of regions have visibly distinct reflective characteristics.

19. A method of making a tamper-evident sealing system for use with an envelope made at least partially of plastic material, the envelope having at least one pocket having an opening therein through which contents can be placed into the pocket, and plastic closing means which when placed over and secured to the plastic envelope material forms a closed pocket, the closing means having at least one transverse edge comprising:

placing a tamper-evident sealing means on the closing means and extending beyond the transverse edge of the closing means, or, alternatively, on the envelope adjacent to where the transverse edge of the closing means overlies the envelope when forming a closed pocket in which case a portion of the tamper-evident sealing means does not adhere to the envelope, which enables the closing means and envelope to be sealed to one another, the tamper-evident sealing means, upon sealing the envelope and closing means together, becoming visibly distorted, broken apart, or of disrupted continuity if attempts are made to reopen the second, tamper-evident sealing means whereby tamper-evidency is provided to the envelope system even if the first sealing means can be reopened and reclosed without visual detection thereof, the tamper-evident sealing means having a first side facing the closing means or envelope upon which it is located and a second side facing away from the closing means or envelope upon which it is located; and providing the tamper-evident sealing means with a pattern of regions, some of said regions having visibly distinct reflective characteristics from others when viewed form said second side of said second tamper-evident sealing means.

20. The method of claim 19 wherein the pattern of regions is provided with the tamper-evident sealing means before the tamper-evident sealing means is placed on the closing means or on the envelope.

21. The method of claim 19 wherein the tamper-evident sealing means is placed on the closing means or on the envelope before the pattern of regions is provided with the tamper-evident sealing means.

22. The method of claim 19 further including the step of placing another adhesive sealing means on the closing means or, alternatively, on the envelope where the closing means overlies the envelope when forming a closed pocket, also for sealing the closing means to the plastic envelope material.

23. A tamper-evident sealing system for use with an envelope made at least partially of plastic material comprising:

envelope pocket having an opening therein through which contents can be placed into the pocket;

plastic closing means which when placed over and secured to the plastic envelope material forms a closed pocket, the closing means having at least one transverse edge;

tamper-evident sealing means located on the closing means and extending beyond the transverse edge of the closing means or, alternatively, on the envelop adjacent to where the transverse edge of the closing means overlies the envelope when forming a closed pocket in which case a portion of the tamper-evident sealing means does not adhere to the envelope, which enables the closing means and envelope to be sealed to one another, the tamper-evident sealing means upon sealing the envelope and closing means together, becoming visibly distorted, broken apart, or of disrupted continuity if attempts are made to reopen the tamper-evident sealing means whereby tamper-evidency is provided to the envelope system; and the tamper-evident sealing means having a first side facing the closing means or envelope upon which it is located and a second side facing away from the closing means or envelope upon which it is located, and a pearlaceous material which is visible when viewed from said second side of the tamper-evident sealing means.

24. The sealing system as in claim 23 wherein said pearlaceous material is visible throughout said second side of the tamper-evident sealing means.

25. The sealing system as in claim 23 wherein said pearlaceous material is visible only in some portions of said second side of the tamper-evident sealing means.

26. The sealing system as in claim 25 wherein said pearlaceous material takes a stripe pattern with an absence of pearlaceous material between the stripes.

27. The sealing system as in claim 23 wherein said pearlaceous material is iridescent.

28. The sealing system as in claim 23 wherein the tamper-evident sealing means contains indicia.

29. The sealing system as in claim 23 wherein the closing means is a flap means integral with the pocket.

30. The sealing system as in claim 23 wherein the closing means is a separate member from the pocket.

31. The sealing system as in claim 23 wherein the tamper-evident sealing means material is one which is activated by placing the closing means onto the envelope over the opening and applying pressure to the sealing means.

32. The sealing system as in claim 23 wherein the portion of the tamper-evident sealing means which does not adhere to the closing means or, alternatively, the envelope has a removable liner thereon to prevent the tamper-evident sealing means form prematurely sticking to an adjacent object.

33. The sealing system as in claim 23 wherein one or more of the edges of the tamper-evident sealing means is serrated, notched or scored.

34. The sealing system as in claim 23 wherein there in a coating over the pearlaceous material.

35. A tamper-evident sealing system for use with an envelope made at least partially of plastic material comprising:

envelope pocket having an opening therein through which contents can be placed into the pocket;

plastic closing means which when placed over and secured to the plastic envelope material forms a closed pocket, the closing means having at least one transverse edge;

first, adhesive sealing means, located on the closing means or, alternatively, on the envelope where the closing means overlies the envelope when forming a closed pocket, for sealing the closing means to the plastic envelope material;

second, tamper-evident sealing means located on the closing means and extending beyond the transverse edge of the closing means, or on the envelope adjacent to where the transverse edge of the closing means overlies the envelop when forming a closed pocket in which case a portion of the second, tamper-evident sealing means does not adhere to the envelope, which enables the closing means and envelope to be sealed to one another, the second, tamper-evident sealing means, upon sealing the envelope and closing means together, becoming visibly distorted, broken apart, or of disrupted continuity if attempts are made to reopen the second, tamper-evident sealing means whereby tamper-evidency is provided to the envelope system even if the first sealing means can be reopened and reclosed without visual detection thereof; and the second, tamper-evident sealing means having a first side facing the closing means or envelope upon which it is located and a second side facing away from the closing means or envelope upon which it is located, and a pearlaceous material which is visible when viewed from said second side of said second tamper-evident sealing means.

36. The sealing system as in claim 35 wherein the second, tamper-evident sealing means comprises a fragile material with an adhesive that forms a highly destructible sealing means.

37. A tamper-evident sealing system for use with an envelope made at least partially of plastic material comprising:

plastic closing means which when placed over and secured to the plastic envelope material forms a closed pocket, the closing means having at least one transverse edge;

first adhesive sealing means, located on the closing means or on the envelope where the closing means overlies the envelope when forming a closed pocket, for sealing the closing means to the plastic envelope material; and second, tamper-evident sealing means located on the closing means and extending beyond the transverse edge of the closing means which enables the closing means to be sealed to the envelope when the closing means is secured to the envelope to form a closed pocket, the second sealing means, once being sealed to the envelope, becoming visibly distorted, broken apart, ≥ of disrupted continuity if attempts are made to reopen the second sealing means whereby tamper-evidency is provided even if the first sealing means can be reopened and reclosed without visual detection thereof; and the second, tamper-evident sealing means having a first side facing the closing means and a second side facing away from the closing means, and a pearlaceous material thereon ≥ therein which is visible when viewed from said second side of the second tamper-evident sealing means.

38. A method of making a tamper-evident sealing system for use with an envelope made at least partially of plastic material, the envelope having at least one pocket having an opening therein through which contents can be placed into the pocket, and plastic closing means which when placed over and secured to the plastic envelope material forms a closed pocket, the closing means having at least one transverse edge comprising:

placing a tamper-evident sealing means on the closing means and extending beyond the transverse edge of the closing means, or, alternatively, on the envelope adjacent to where the transverse edge of the closing means overlies the envelope when forming a closed pocket in which case a portion of the tamper-evident sealing means does not adhere to the envelope when forming a closed pocket in which case a portion of the tamper-evident sealing means does not adhere to the envelope, which enables the closing means and envelope to be sealed to one another, the tamper-evident sealing means, upon sealing the envelope and closing means together, becoming visibly distorted, broken apart, or of disrupted continuity if attempts are made to reopen the second, tamper-evident sealing means whereby tamper-evidency is provided to the envelope system even if the first sealing means can be reopened and reclosed without visual detection thereof, the tamper-evident sealing means having a first side facing the closing means or envelope upon which it is located and a second side facing away form the closing means or envelope upon which it is located; and providing the tamper-evident sealing means with a pearlaceous material which is visible when viewed form said second side of said second tamper-evident sealing means.

39. The method of claim 38 wherein the pearlaceous material is provided with the tamper-evident sealing means before the tamper-evident sealing means is placed on the closing means or envelope.

40. The method of claim 38 wherein the tamper-evident sealing means is provided to the closing means or, alternatively, to the envelope before the pearlaceous material is provided with the tamper-evident sealing means.

41. The method of claim 38 further including the step of placing another adhesive sealing means on the closing means or, alternatively, on the envelope where the closing means overlies the envelope when forming a closed pocket, also for sealing the closing means to the plastic envelope material.

42. A tamper-evident sealing system for use with an envelope made at least partially of plastic material comprising:

envelope pocket having an opening therein through which contents can be placed into the pocket;

plastic closing means which when placed over and secured to the plastic envelope material forms a closed pocket, the closing means having at least one transverse edge;

first, pressure-activated, adhesive sealing means, located on the closing means or, alternatively, on the envelope where the closing means overlies the envelope when forming a closed pocket, for sealing the closing means to the plastic envelope material;

second, tamper-evident sealing means located on the closing means and extending beyond the transverse edge of the closing means, or on the envelope adjacent to where the transverse edge of the closing means overlies the envelope when forming a closed pocket in which case a portion of the second, tamper-evident sealing means does not adhere to the envelope, which enables the closing means and envelope to be sealed to one another, the second, tamer-evident sealing means, upon sealing the envelope and closing means together, becoming visibly distorted, broken apart, or of disrupted continuity if attempts are made to reopen the second, tamper-evident sealing means whereby tamper-evidency is provided to the envelope system even if the first sealing means can be reopened and reclosed without visual detection thereof; and the second, tamper-evident, sealing means comprising paperstock with an adhesive thereon.

* * * * *

UNITED STATES PATENT AND TRADEMARK OFFICE

CERTIFICATE OF CORRECTION

PATENT NO. : 5,077,001

DATED : December 31, 1991

INVENTOR(S) : Kenneth R. Makowka

It is certified that error appears in the above-identified patent and that said Letters Patent is hereby corrected as shown below:

Claim 42 is removed by deleting Col. 21, lines 3-18 and Col. 22, lines 1-17.

Signed and Sealed this

Tenth Day of May, 1994

*Attest:*

Bruce Lehman

BRUCE LEHMAN

*Attesting Officer*

*Commissioner of Patents and Trademarks*